United States Patent [19]

Hayes

[11] 4,226,367

[45] Oct. 7, 1980

[54] SQUEEZE BOTTLE DISPENSER

[75] Inventor: Thomas H. Hayes, Baton Rouge, La.

[73] Assignee: Ethyl Corporation, Richmond, Va.

[21] Appl. No.: 968,639

[22] Filed: Dec. 11, 1978

[51] Int. Cl.[2] ..... B05B 1/26; B65D 1/32

[52] U.S. Cl. ..... 239/327; 123/200.22; 239/426; 261/78 A; 261/DIG. 65

[58] Field of Search ..... 239/327, 338, 426; 261/78 A, DIG. 65; 128/194, 173 R

[56] References Cited

U.S. PATENT DOCUMENTS

| | | | |
|---|---|---|---|
| 2,764,453 | 9/1956 | Robb et al. | 239/327 |
| 3,401,845 | 9/1968 | Bach | 239/327 |
| 3,421,692 | 1/1969 | Babington et al. | 239/426 |
| 3,421,699 | 1/1969 | Babington et al. | 239/426 |
| 3,425,059 | 1/1969 | Babington | 239/426 |
| 3,606,159 | 9/1971 | Sutton | 239/426 |
| 3,751,210 | 8/1973 | Babington et al. | 431/237 |
| 3,910,501 | 10/1975 | Tyronne et al. | 239/426 |

*Primary Examiner*—Robert W. Saifer
*Assistant Examiner*—Michael J. Forman
*Attorney, Agent, or Firm*—Donald L. Johnson; John F. Sieberth; David L. Ray

[57] ABSTRACT

An apparatus for dispensing liquid including a flexible container for storing liquid, a closure connected to the container, a cap rotatably connected to the closure having an orifice therein, a film-forming post connected to the closure with an orifice therein alignable with the orifice in the cap, a stem projecting upwardly from the closure for conveying liquid to the film-forming post, and a dip tube connected to the stem for conveying liquid from the container to the stem.

23 Claims, 11 Drawing Figures

SQUEEZE BOTTLE DISPENSER

BACKGROUND OF THE INVENTION

This invention relates to squeeze bottle dispensers and, more particularly, to such dispensers wherein a liquid spray is discharged from the dispenser by squeezing the container.

Squeeze bottle dispensers are utilized for packaging and dispensing a wide variety of liquids. When the dispenser is actuated by squeezing the sides of the container, the liquid is sprayed out of the dispenser through an orifice in the dispenser closure. The liquid is discharged through and out of the orifice in a spray pattern.

With some materials such as quick-drying antiperspirants, the uniformity of the spray pattern and the size of the liquid and solid particles in the pattern and variations in the size of the liquid particles during the time when the contents of the dispenser are being used can adversely affect the spray application of the liquid and the effectiveness of such liquid.

Various attempts have been made to improve the spray pattern and uniformity of the particle size of the liquid spray from squeeze bottle dispensers. Such attempts have included arrangements in the valves, the orifices, and the internal diameter of thedip tube.

Exemplary methods for converting liquids into fine spray are those disclosed in U.S. Pat. No. 3,421,692 and U.S. Pat. No. 3,421,699, which are hereby incorporated by reference. In these patents liquid is introduced onto a smooth surface having an aperture therethrough which causes the liquid to "film out" on the surface either by surface tension or by the shape of the surface so the liquid is under stress before it reaches the aperture. The film flows past the aperture through which a gaseous dispensing medium is discharged to create minuscle particles with a thin liquid film to form a fine particle spray.

SUMMARY OF THE INVENTION

In accordance with the invention there is provided an apparatus for dispensing liquid including a flexible container for storing liquid, a closure connected to the container, a cap rotatably connected to the closure having an orifice therein, a filmforming post connected to the closure with an orifice therein alignable with the orifice in the cap, a stem projecting upwardly from the closure for conveying liquid to the film-forming post, and a dip tube connected to the stem for conveying liquid from the container to the stem.

DESCRIPTION OF THE PREFERRED EMBODIMENTS

Figure 1:
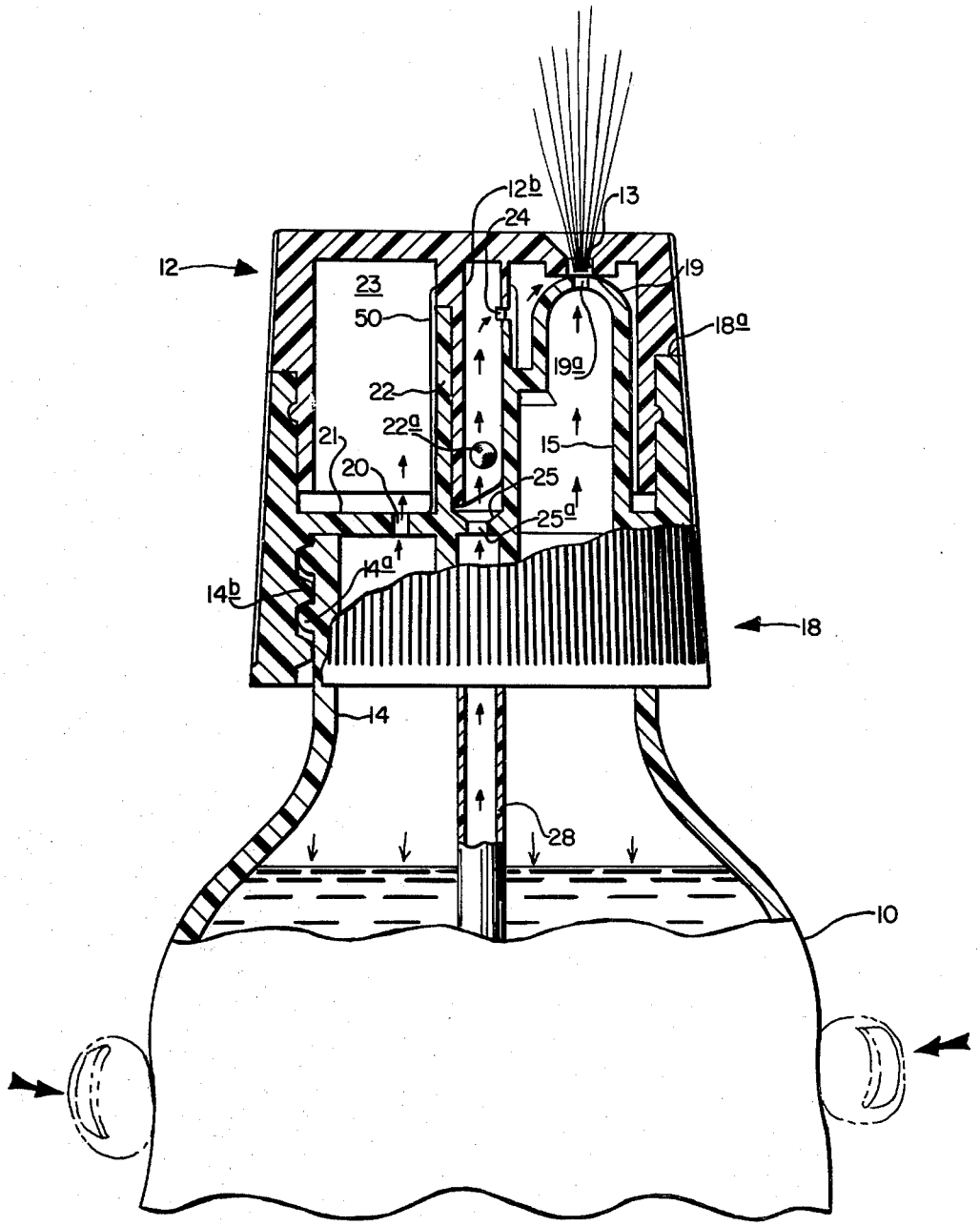
FIG. 1 is a partly cross-sectional, partly cut-away view of the cap and closure of the present invention.
Figure 2:
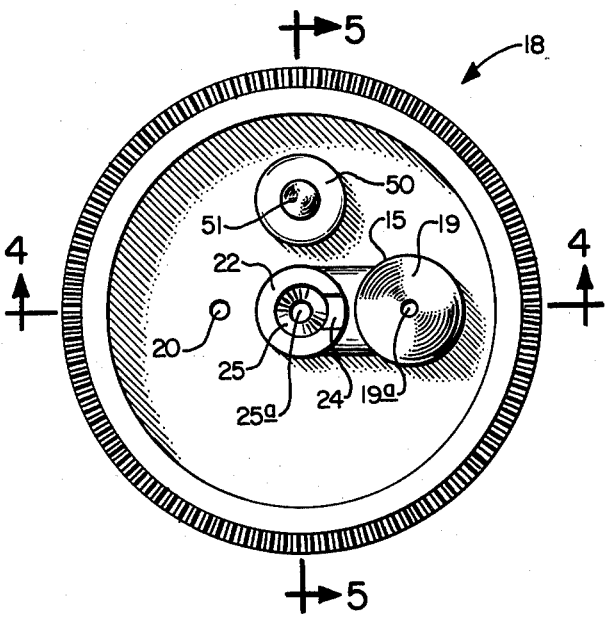
FIG. 2 is a top plan view of the closure of the present invention.
Figure 3:
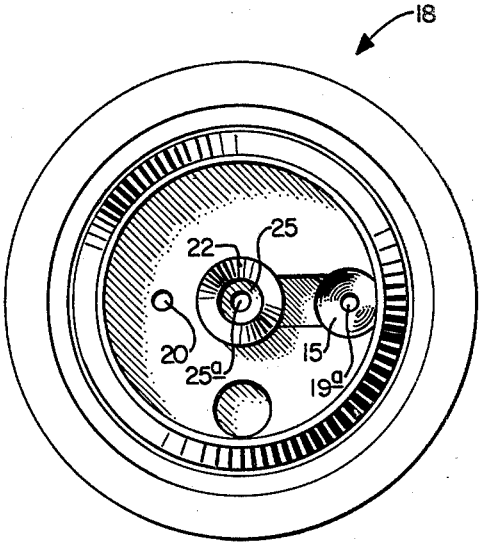
FIG. 3 is a bottom plan view of the closure of the present invention.

Referring now to the drawings, in particular to FIG. 1, liquid to be dispensed can be seen to be held in a container 10 which has an upper portion 14 for receipt of closure 18. The upper portion 14 of container 10 has threads **14*a* which engage threads 14*b* on closure 18 to secure closure 18 to container 10. As is wellknown in the art, container 10 may be formed without threads and closure 18** affixed thereto by gluing, snapping, or the like.

Closure 18 has a generally flat, circular floor portion 21. Located above floor 21 is chamber 23. Floor 21 has a hole 20 therein through which liquids from chamber 23 may drain into container 18.

Extending upwardly from floor 21 is film-forming post 15. Post 15 has an upper surface 19 onto which liquid is directed to form a thin film. The thin film formed on upper surface 19 passes over orifice **19*a* and post 15**.

The upper surface 19 of post 15 must be sufficiently smooth so that a film of liquid may be formed thereover, and the point of application of liquid must be a distance sufficient from the aperture **19*a*** to prevent formation of the film before the liquid passes over the aperture. This has been explained in U.S. Pat. No. 3,421,692 and U.S. Pat. No. 3,421,699.

The shape and conture of the aperture has an effect on spray uniformity and capacity, and aperture or orifice **19*a* is preferably round in shape. Also, the walls of the aperture can be parallel and diverge outwardly from the upper surface 19 of post 15. As shown in the drawings, aperture 19*a*** is simply a round hole having a straight-through circumferential wall.

Stem 22 is shown projecting upwardly from floor 21 of closure 18 and is adjacent to post 15. Stem 22 can be seen to be a hollow cylinder generally open at the end and having an opening or notch 24 in the side of the upper end thereof through which liquid passes prior to impinging upon curved surface 19 of post 15.

Stem 22 is generally circular in cross-section and has an inner flange 25 at the lower end against the bottom of which is fitted dip tube 28 and against the top of which is fitted ball check valve **22*a*. Ball 22*a* forms a liquid seal with flange 25 to maintain dip tube 28 fully filled with liquid. Inner flange 25 surrounds a hole 25*a* through which liquid from dip tube 28 flows when the container 10 is squeezed. As can be seen in FIG. 1, dip tube 28 is received in the lower end of stem 22**.

Figure 10:
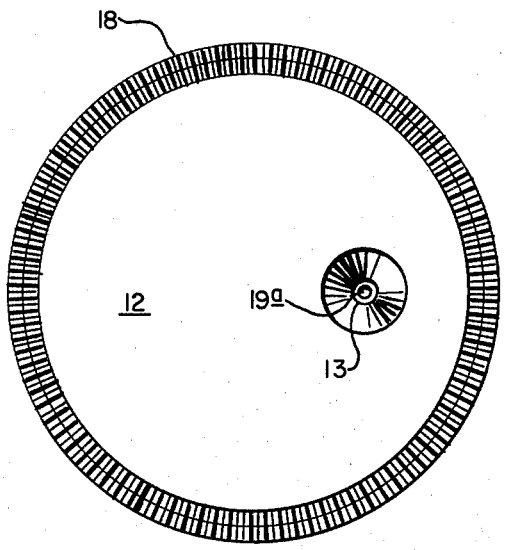
FIG. 10 is a top view of the closure of the cap inserted on the closure of the present invention; and, FIG. 11 is a top view of the cap inserted on the closure of the present invention turned to angle alpha respective to the view shown in FIG. 10.
Figure 11:
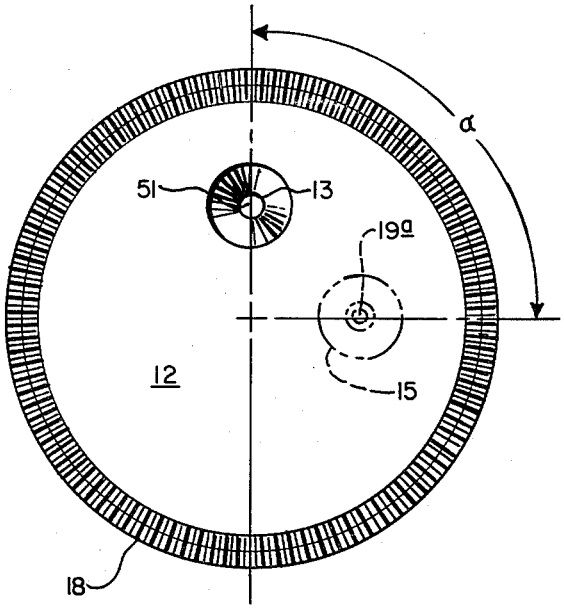

Also located on closure 18 is post 50 containing on the top end tab 51. Tab 51 mounted on post 50 is adapted to seal orifice 13 in cap 12 when the cap is rotated to the proper position as shown in FIGS. 10 and 11.

Located at the upper end and attached to closure 18 is cap 12 having exit orifice 13 therein. Cap 12 is shown snapped to the interior of closure 18 to hold cap 12 in place on closure 18. As can be seen most clearly in FIG.

8, a tab 60 extends around the outer periphery of cap 12 and is received in slot 61 contained in closure 18. Cap 12 can rotate about closure 18 as shown in FIGS. 10 and 11.

Figure 9:
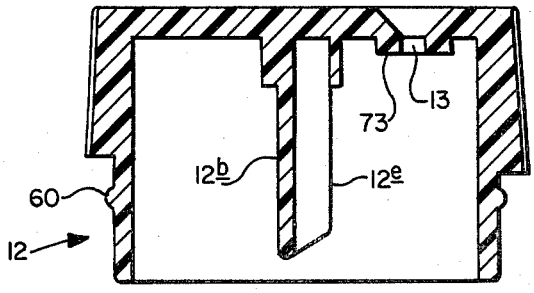
FIG. 9 is a cross-sectional view taken along lines 9—9 of FIG. 6.

As can be seen in FIGS. 1 and 9, tab 12*b* extends downwardly from the top of cap 12. Tab 12*b* is rotatably received in stem 22 and is open on one side 12*e*. Also surrounding orifice 13 on the underside of cap 12 is a circular ridge 73.

To seal orifice 13, cap 12 is rotated so that orifice 13 is no longer aligned with orifice 19 and post 50 and tab 51 form a liquid-tight seal with orifice 13. Thus, when cap 12 is rotated from the position shown in FIG. 10 to the position shown in FIG. 11, orifice 13 is completely sealed and no fluids can leak from the container.

Figure 4:
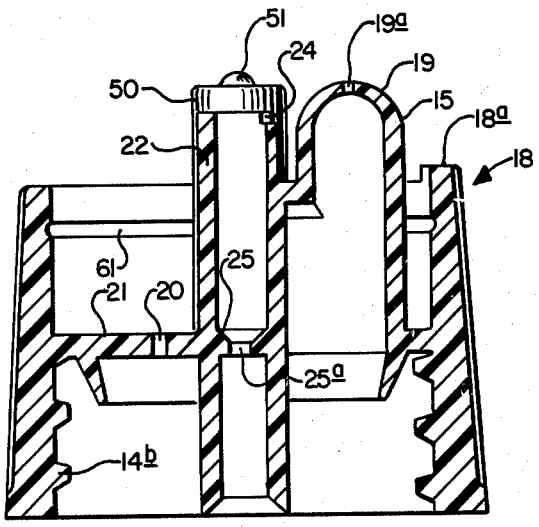
FIG. 4 is a cross-sectional view taken along lines 4—4 of FIG. 2.
Figure 5:
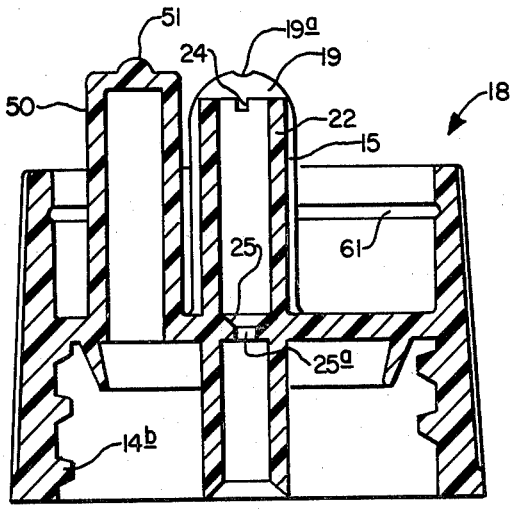
FIG. 5 is a cross-sectional view taken along lines 5—5 of FIG. 2.
Figure 6:
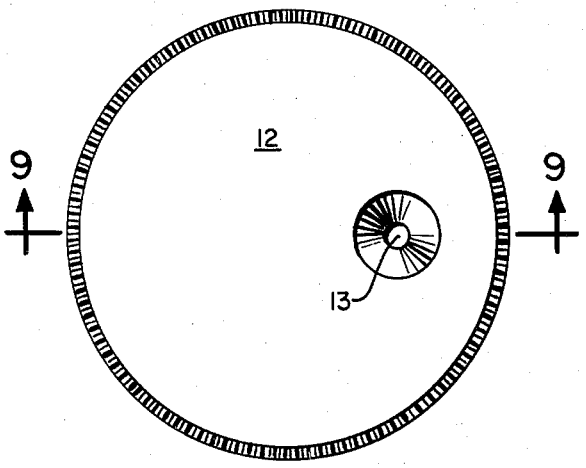
FIG. 6 is a top plan view of the cap of the present invention.
Figure 7:
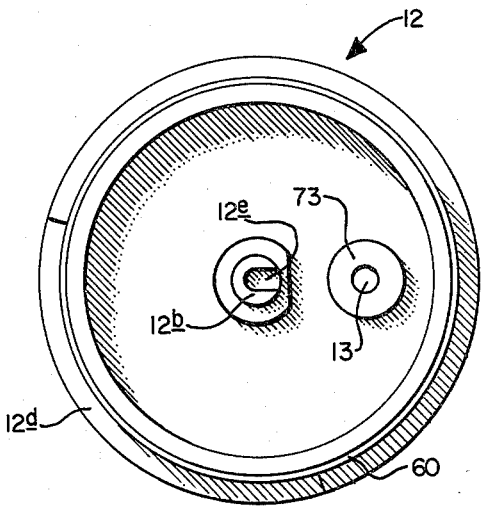
FIG. 7 is a bottom plan view of the cap of the present invention.
Figure 8:
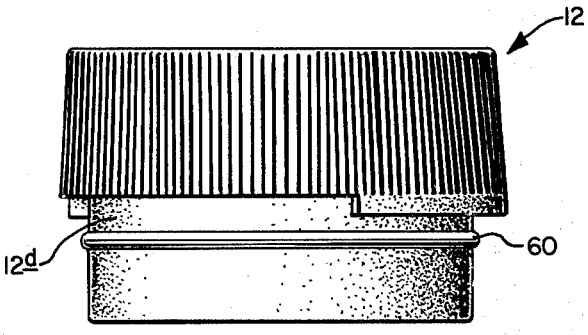
FIG. 8 is a side elevational view of the cap of the present invention.

Closure 18 has a tab 18*a* thereon as shown in FIGS. 1 and 4, which projects upwardly from the sides of closure 18 and is slidably received in slot 12*d* of cap 12. Thus, as shown in FIGS. 10 and 11, when cap 12 is rotated counterclockwise (when viewed from the top), tab 18*a* strikes one edge of slot 12*d* and the dispenser is operational. When cap 12 is rotated counterclockwise (when viewed from the top), tab 18*a* strikes the other extremity of slot 12*d* indicating that the container is fully closed.

FIG. 1 illustrates the manner in which the dispenser functions. When the sides of container 10 are compressed as shown in FIG. 1 by the fingers of the user, the air inside of container 10 is compressed or pressurized and liquids are forced upwardly from the bottom of dip tube 28 into stem 22, around check ball 22*a*, and outwardly through channel 24. As the liquids exit through channel 24 they strike the upper curved surface 19 of post 15. Due partly to the velocity of the liquid and the smooth surface 19, a thin film is formed over the surface 19 downward to orifice 19*a*.

Gas or air under pressure in the interior of container 10 travels upward through the interior of post 15 and through hole 20 as indicated by the arrows. The air traveling upward through post 15 then exits outwardly through orifice 19*a*, and the air traveling upward through hole 20 flows over post 15 and out through orifice 13 to produce finer particles of spray than is produced when hole 20 is plugged. As air exits through orifice 19*a* it strikes a thin film of liquid on the outer surface 19 of post 15 causing minuscle particles of liquid to break away from the film to produce a very fine uniform spray. The uniform spray continues outwardly through orifice 13 in cap 12.

It is thought that the invention and many of its attendant advantages will be understood from the foregoing description and it will be apparent that various changes may be made in the form, construction, and arrangement of the parts without departing from the spirit and scope of the invention, the forms hereinbefore described being merely preferred embodiments thereof.

What is claimed:

1. An apparatus for dispensing liquid, comprising:
   a. flexible container means for storing said liquid;
   b. closure means connectable to said container means;
   c. film-forming means connected to said closure means, said film-forming means having first orifice means therein through which gas or air from said container is sprayed;
   d. cap means having a generally horizontal top rotatably connected to said closure means, said cap means having second orifice means in said top alignable with said first orifice means;
   e. stem means connected to said closure means, said stem means having channel means through which liquid can exit said stem means and strike said film-forming means; and,
   f. dip tube means connected to said stem means for conveying said liquid from said container to said stem means.

2. The apparatus of claim 1 wherein said dip tube means extends into said container means.

3. The apparatus of claim 2 wherein said dip tube means is connected to the lower end of said stem means.

4. The apparatus of claim 1 wherein said closure means contains a floor means defining an upper chamber means between the interior of said cap means and said floor means, said floor means having a hole therein for allowing liquids contained in said upper chamber means to drain downwardly into said container means.

5. The apparatus of claim 4 wherein said stem means has check ball means therein for sealing said stem means.

6. The apparatus of claim 1 wherein said film-forming means is located adjacent to said stem means and aligned with channel means in said stem means to receive liquid flowing from said channel means.

7. The apparatus of claim 6 wherein said film-forming means comprises a first post means having said first orifice means therein through which gas or air from said container is sprayed.

8. The apparatus of claim 7 wherein said first post means has a hollow chamber therein which communicates with the interior of said container.

9. The apparatus of claim 8 wherein said first post means is connected to said closure means.

10. The apparatus of claim 9 wherein said first post means is contained within said cap means when said cap means is connected to said closure means.

11. The apparatus of claim 10 wherein said first post means has a curved exterior surface over which said liquid flows prior to said liquids reaching said first orifice means.

12. The apparatus of claim 1 wherein said liquid is dispensed from said second orifice means in a direction generally parallel to the longitudinal axis of said dip tube.

13. The apparatus of claim 12 wherein said closure means has second post means connected thereto for sealing said second orifice means and said cap means has slot means therein in which tab means connected to said closure means is slidably received, said tab means and said slot means cooperating to align said first and second orifices to dispense liquids or to align said second post means with said second orifice means to seal said second orifice means.

14. The apparatus of claim 13 wherein said cap means has third post means which is rotatably received in the upper end of said stem means.

15. The apparatus of claim 14 wherein said stem means has channel means at the upper end thereof for directing liquid from said container onto said curved exterior surface of said first post means of said film-forming means.

16. An apparatus for dispensing liquid, comprising:
   a. flexible container means for storing said liquid; P1
   b. closure means connectable to said container means;
   c. cap means having a generally horizontal top rotatably connected to said closure means, said cap means having second orifice means in said top alignable with first orifice means;

d. stem means connected to said closure means, said stem means having channel means through which liquid can exit said stem;

e. dip tube means connected to said stem means for conveying liquid from said container to said stem means, and, f. film-forming means connected to said closure means, said film-forming means having said first orifice means therein, said film-forming means being located adjacent to said stem means and aligned with said stem means to receive liquid flowing through channel means in said stem means, said film-forming means comprising first post means having said first orifice means therein throuh which gas or air from said container is sprayed, said post means having a hollow chamber therein which communicates with the interior of said container, said post means being connected to said closure means, said post means having a curved exterior surface over which said liquid flows prior to said liquid reaching said second orifice means.

17. The apparatus of claim 16 wherein said closure means contains a floor means defining an upper chamber means between the interior of said cap means and said floor means, said floor means having a hole therein for allowing liquids contained in said upper chamber means to drain outwardly into said container means.

18. The apparatus of claim 17 wherein said insert means has ball means therein for sealing said stem means to maintain said dip tube means fully filled with liquid.

19. The apparatus of claim 16 wherein said liquid is dispensed from said second orifice in a direction generally parallel to the longitudinal axis of said dip tube.

20. The apparatus of claim 19 wherein said closure means has second post means connected thereto for sealing said second orifice means and said cap means has slot means therein in which tab means connected to said closure means is slidably received, said tab means and said slot means cooperating to align said first and second orifices to dispense liquids or to align said second post means with said second orifice means to seal said second orifice means.

21. The apparatus of claim 20 wherein said cap means has third post means which is rotatably received in the upper end of said stem means.

22. The apparatus of claim 21 wherein said stem means has channel means at the upper end thereof for directing liquid from said container onto said curved exterior surface of said first post means of said film-forming means.

23. The apparatus of claim 22 wherein said second post means has tab means thereon for sealing said second orifice means.

* * * * *

UNITED STATES PATENT AND TRADEMARK OFFICE

CERTIFICATE OF CORRECTION

PATENT NO. : 4,226,367

DATED : OCTOBER 7, 1980

INVENTOR(S) : THOMAS H. HAYES

It is certified that error appears in the above-identified patent and that said Letters Patent are hereby corrected as shown below:

Column 1, line 27, "thedip tube" should read -- the dip tube --. Column 1, line 46, "filmforming" should read -- film-forming --. Column 2, line 18, "wellknown" should read -- well-known --. Column 4, Claim 12, line 1, "of claim 1" should read -- of claim 11 --. Column 4, Claim 16, line 2, delete "P1" at end of line. Column 5, Claim 16, line 17, "throuh" should read -- through --.

On the title page insert

-- /*/ Notice: The portion of the term of this patent subsequent to Sep. 23, 1997, has been disclaimed. --

Signed and Sealed this

Tenth Day of February 1981

[SEAL]

Attest:

RENE D. TEGTMEYER

Attesting Officer

Acting Commissioner of Patents and Trademarks